US008409390B2

(12) United States Patent
Untch

(10) Patent No.: US 8,409,390 B2
(45) Date of Patent: Apr. 2, 2013

(54) METHOD FOR THE ENVIRONMENTALLY SEALED CONNECTED OF TWO AT LEAST PARTIALLY FLEXIBLE RECEPTACLES

(75) Inventor: Günter Untch, Müllheim (DE)

(73) Assignee: Flecotec AG, Mullheim (DE)

( * ) Notice: Subject to any disclaimer, the term of this patent is extended or adjusted under 35 U.S.C. 154(b) by 0 days.

(21) Appl. No.: 13/264,600

(22) PCT Filed: Mar. 26, 2010

(86) PCT No.: PCT/EP2010/001915

§ 371 (c)(1),
(2), (4) Date: Nov. 29, 2011

(87) PCT Pub. No.: WO2010/118817

PCT Pub. Date: Oct. 21, 2010

(65) Prior Publication Data

US 2012/0085490 A1 Apr. 12, 2012

(30) Foreign Application Priority Data

Apr. 17, 2009 (DE) ..... 10 2009 017 545

(51) Int. Cl.
*B32B 37/00* (2006.01)

(52) U.S. Cl. ..... 156/251; 156/252; 156/253; 156/308.4

(58) Field of Classification Search ..... 156/73.5, 156/247, 250, 252, 253, 308.2, 308.4, 251
See application file for complete search history.

(56) References Cited

U.S. PATENT DOCUMENTS

| | | | | |
|---|---|---|---|---|
| 6,251,209 | B1 * | 6/2001 | Johnson | 156/256 |
| 6,565,688 | B2 * | 5/2003 | Sfikas et al. | 156/73.3 |
| 7,398,804 | B2 | 7/2008 | Koch et al. | |
| 7,634,896 | B2 | 12/2009 | Multer et al. | |
| 7,651,579 | B1 * | 1/2010 | Reuhs et al. | 156/244.11 |
| 2007/0251599 | A1 | 11/2007 | Denk et al. | |
| 2010/0012225 | A1 | 1/2010 | Schnyder | |
| 2010/0132215 | A1 | 6/2010 | Denk | |

FOREIGN PATENT DOCUMENTS

| | | | |
|---|---|---|---|
| CN | 1575241 | A | 2/2005 |
| DE | 10 2004 005 961 | A1 | 7/2005 |
| DE | 10 2005 961 | A1 | 7/2005 |
| DE | 10 2006 057 760 | B3 | 7/2008 |
| EP | 1 702 866 | A1 | 9/2006 |
| WO | WO 2005/056443 | A1 | 6/2005 |
| WO | WO 2008/078221 | A1 | 7/2008 |

* cited by examiner

*Primary Examiner* — James Sells
(74) *Attorney, Agent, or Firm* — Muirhead and Saturnelli, LLC

(57) ABSTRACT

A method for contamination-free docking of a first at least partially flexible receptacle to a second at least partially flexible receptacle. The receptacles include, at least in part, films having outer sides that can be solidly welded, and inner sides can be detachably welded. According to the described system, a solid connection between the receptacles is produced outside the detachably welded inner sides in order to create a channel between the receptacles. The channel is opened by loosening the connection between the inner sides.

12 Claims, 7 Drawing Sheets

METHOD FOR THE ENVIRONMENTALLY SEALED CONNECTED OF TWO AT LEAST PARTIALLY FLEXIBLE RECEPTACLES

TECHNICAL FIELD

This application relates to a method for the environmentally sealed connection of a first at least partially flexible receptacle to a second at least partially flexible receptacle.

BACKGROUND OF THE INVENTION

In the further processing of raw materials, which would represent a considerable health risk for the persons working with these materials in the event of direct contact therewith, increased cleanliness or absolutely contamination-free working has to be ensured in many branches of industry, for example the pharmaceutical or chemical industry.

There is in particular a risk of contamination to the working environment of persons and/or generally to the environment and/or of corresponding exposure of the persons themselves when the raw materials are present in the form of powder or granules. Such raw materials should be handled in appropriate containers. Use is made of containers comprising flexible receptacles or containers comprising stable frames that contain flexible receptacles. As flexible receptacles, use is made preferably of film tube sections from continuous receptacles, what are known as continuous liners, which are separated into sections depending on the portioning of the raw materials. They are available as individually filled receptacles to consumers, who use them further in a contamination-free manner.

The consumer connects such receptacles together in order to make raw materials contained therein available continuously to a method. This "connecting together" is what is known as docking. The connecting has to take place in an environmentally sealed manner, in order to avoid contamination to the environment.

In known devices, docking is still awkward to carry out against the background of contamination problems. Known devices for filling or emptying such receptacles are described in DE 10 2006 057 760 B3 or EP 1 702 866 A1.

Furthermore, what are known as peelable films, which can be welded firmly on the outer side and can be welded less firmly on the inner side, have been known for some time. Welding of such peelable inner sides can be released by pulling perpendicularly to the plane of the film without the walls of the film itself being damaged. Consequently, the walls remain environmentally sealed in the region of the released weld seam.

Thus, it is known for example that chip bags for potato chips can be opened in that a weld seam at one end of the chip bag can be released by pulling laterally and so the chip bag is opened cleanly at the top.

Consequently, it would be desirable to provide a cost-effective method for the environmentally sealed connection of two flexible receptacles, said method being easy to carry out and absolutely clean, in particular contamination-free.

SUMMARY OF THE INVENTION

The system described herein allows an environmentally sealed connection, called contamination-free docking in the following text, of a first at least partially flexible receptacle to a second at least partially flexible receptacle. A method according to the system described herein allows a raw material to flow through in a throughflow direction between such receptacles that are docked in a contamination-free manner.

At the beginning of the method, the receptacles consist, at least in a docking region, of films which have outer sides that can be firmly welded and inner sides that can be welded releasably to an inner seam. They are preferably receptacles made of internally peelable films mentioned at the beginning. At the beginning of the method, at least one of the receptacles is usually present in a state filled with the raw material. Regardless of the type of filling, at least one end of each receptacle is welded such that it can be released on the inner side.

In order to reach a starting position, the receptacles to be welded together are arranged opposite one another with a receiving end of the second receptacle and a penetrating end of the first receptacle in a docking region.

The system described herein provides two alternative method steps, which are carried out starting from this starting position as far as a first welding operation, in order to arrive at a comparable result of receptacles that are connected together.

According to a first of the alternative method steps, the receiving end is turned inward so as to produce a receiving region. This is followed by insertion of the penetrating end into the receiving region. The ends thus lie or hang in one another. In a welding region located inside the receiving region, the inwardly turned outer sides of the receiving end overlap the outer sides of the penetrating end. In this position, the ends are prepared for a welding operation.

According to a second of the alternative method steps, either one strip which encircles the ends or two strips which are not connected together are arranged on both sides of the receptacles in a direction parallel to the course of the ends over the entire width thereof or exceeding the latter. The at least one strip thus covers the region between the ends of the receptacles on both sides and projects in the throughflow direction beyond end sections of the ends so as to ensure that the strip overlaps the two ends completely.

The strips, or the encircling strip, consist at least partially of films having inner sides that can be firmly welded. Such strips can consist in particular of films mentioned at the beginning that are peelable on one side, a peelable outer side initially remaining unused.

Thus, the ends project between the strips, which can be configured particularly advantageously as a continuous strip, and in this way are received in a receiving region between the strips. In a welding region located inside the receiving region, the strips, or the encircling strip, overlap the outer sides of the two ends penetrating between the strips. In this position, the ends are prepared for welding to the strips, or the encircling strip, in the welding region.

Overlapping of the ends by the receiving end being turned inward according to the first alternative method steps thus corresponds in an analogous manner to overlapping of the at least one strip with the ends in the second of the alternative method steps.

Following welding, regardless of whether the first or the second alternative method step has been chosen, the receptacles are connected together but are still closed with respect to one another. A throughflow from one receptacle into the other receptacle is not yet possible. The inner sides of the penetrating end and the inner sides of the receiving end are each welded releasably together. These releasable connections are the only obstacle to the throughflow following welding.

Following welding, the ends are pulled laterally. The releasably welded inner sides of the ends are preferably peelable. Accordingly, the lateral pulling leads to the opening of the receptacles with respect to one another. The firm welded connections at the outer sides of the ends remain intact and the walls of the receptacles are not damaged. Outside the released inner seams, the receptacles are thus connected together in a tubular and environmentally sealed manner following the lateral pulling, and so throughflow which is environmentally sealed toward the outside is enabled.

The method according to the system described herein allows tubular connection with very simple means, specifically exclusively a device for welding, in particular hot welding. The tubular connection between the receptacles docked in this way is produced in a contamination-free or environmentally sealed manner. The raw material enclosed inside the receptacles has no opportunity at any time during the method to contaminate a surrounding work environment. In the process, properties of the peelable films are exploited in an optimum manner. The solution according to the first of the alternative method steps is particularly expedient, in that the different properties of the inner sides and outer sides of the films are used in that the corresponding sides of the two receptacles are placed in a specific manner on one another and are welded at a suitable point in a single method step.

The method can advantageously be extended, following the lateral pulling, by a first additional welding operation and a first separating operation on a first side of the receiving region, in particular by a cutting and sealing operation. After the first separating operation at a first separating point, the first receptacle is separate and has an end that is closed on the inner sides, as at the beginning of the method. In the same method step, the receiving region is closed on a first side. Here, too, two inner sides of the film are welded releasably together.

Advantageously, after the first separating operation, the first receptacle is again in a state in which it can be docked by the method according to the invention to a third receptacle. The initial situation is consequently reestablished at the first receptacle. It is also particularly advantageous that no contamination could take place, since the first separating operation takes place in the welding region of the first additional welding operation such that the releasably welded inner sides remain welded together in a sealed manner on both sides of a first separating line as long as there is no lateral pull acting on the inner sides. This is based on the ideal case that the weld seams can be realized in a sufficiently wide manner. Generally, provision can also be made for a separation between two produced weld seams, although this involves the risk of slight contamination.

According to a further variant of the method, in particular in addition to the first additional welding operation and the first separating operation, a second additional welding operation and a second separating operation take place, in particular by a cutting and sealing operation, on a second side of the receiving region at a second separating point. As a result, the second receptacle, too, is closed cleanly again.

The receiving region is in a separate and closed form after the first and second additional welding operations and the first and second separating operations, so that, here too, no contamination could take place. A receiving region closed off in this way can be disposed of separately.

The first and second separating operations should be understood to mean at least partial separation, which is carried out at the separating points in particular also in sections over the entire cross section. It is particularly advantageous to provide the separating points as perforated lines. The user can thus decide in a flexible manner whether and when the receptacles are separated completely from one another, in particular when the closed receiving region is completely detached from one of the receptacles.

A method according to the system described herein is carried out advantageously with a corresponding device, in particular a device for hot welding and/or a device for in particular perforating separation or a combination of such devices.

BRIEF DESCRIPTION OF THE DRAWINGS

Embodiments of the system described herein are explained in more detail in the following text on the basis of drawings. The figures show in each case a sectional view and a side view (a to i designate method steps), wherein:

FIG. 11 shows schematically simplified illustrations- comparable to the illustrations in FIG. 6- of two separate receptacles which have been closed by a new welding operation (e, g), starting from FIG. 10, and a closed-off and separate receiving region located in between.

DETAILED DESCRIPTION OF VARIOUS EMBODIMENTS

FIGS. 1 to 5 illustrate intermediate results following necessary method steps a, b.1.1, b.1.2, c and d of a first exemplary embodiment of the method according to the invention, as take place one after the other in accordance with the numbering of FIGS. 1 to 5.

Figure 7:
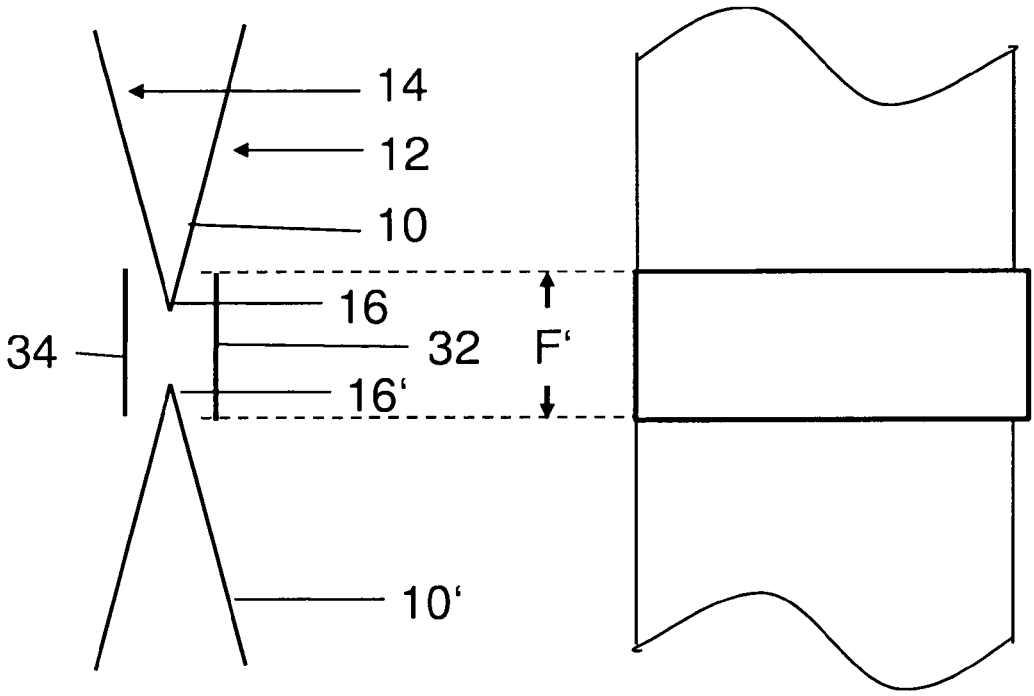
Figure 8:
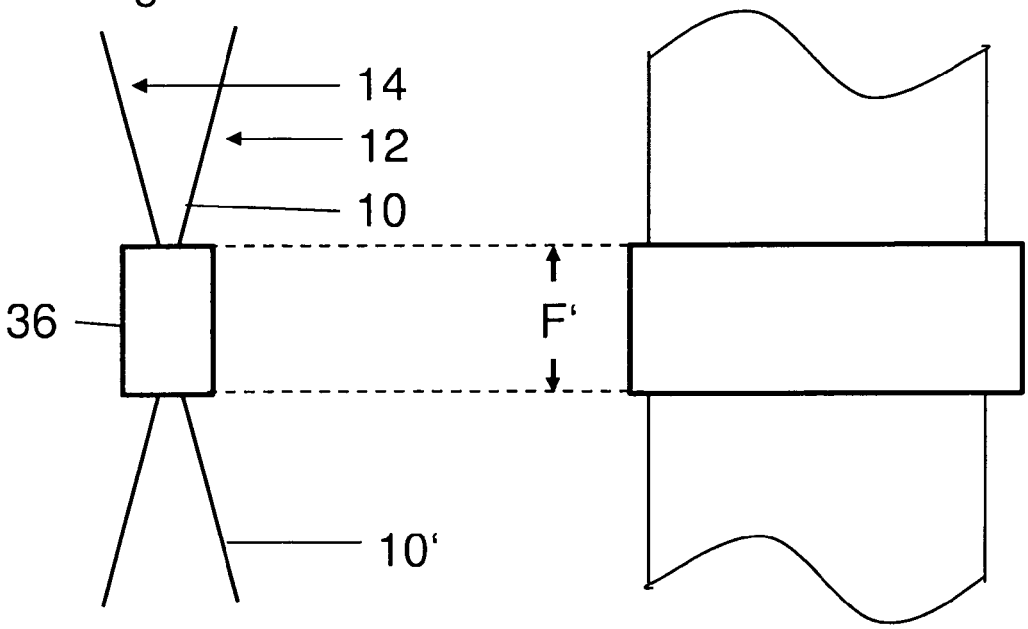
FIG. 8 shows schematically simplified illustrations of the ends from FIG. 1, wherein, in contrast to FIG. 7, according to a third exemplary embodiment of a method according to the system described herein, an encircling strip is arranged (b.2) in the docking region and the encircling strip bridges the gap between the receptacles and at least partially encloses the ends.

FIGS. 1, 7, 9 and 10 and FIGS. 1 and 8 to 10 illustrate intermediate results following necessary method steps a, b.2, c and d of a second and a third exemplary embodiment, respectively, of the method according to the invention, as take place one after the other in accordance with the abovementioned numbering of the figures. FIG. 8 should thus be considered to be an alternative to FIG. 7 and to be a third exemplary embodiment.

With each intermediate result, a penetrating end 16 of a first flexible receptacle 10 and/or a receiving end 16' of a second flexible receptacle are in an altered form, until they are finally docked together. The receptacles 10, 10' each have outer sides 12 that can be firmly welded and inner sides 14 that can be releasably welded. During the course of the method, the outer sides 12 and inner sides 14, which have different properties, are placed together in a specific manner in pairs having the same properties and are finally hot-welded.

In the figures, identical parts are designated by the same reference signs. For reasons of improved clarity, not all of the reference signs are given in all of the figures.

The flexible receptacles 10, 10' each consist at least one end 16, 16' of a special film. The special film is treated on one side such that the two sides of the film have different adhesion properties following hot-welding. During docking, a breaking weld is intended to be produced, said breaking weld firmly welding only the outer sides 12 of the films while the inner sides 16 are welded in a releasable manner. Such films are also called peelable films.

Figure 1:
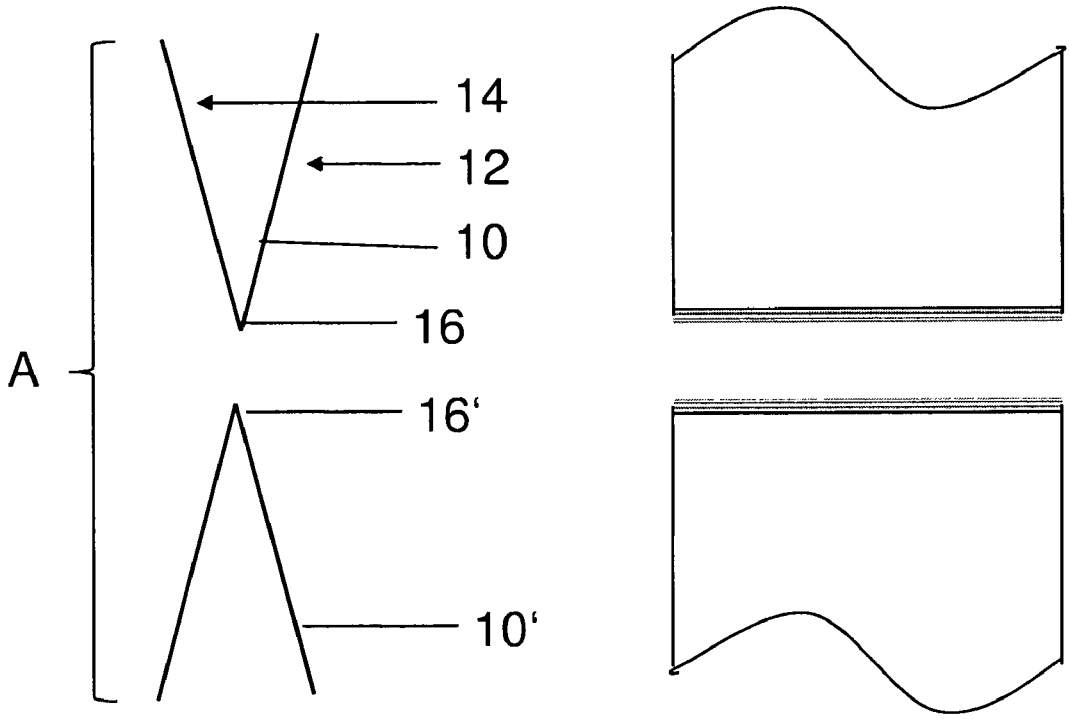
FIG. 1 shows schematically simplified illustrations of an arrangement of two ends (a) of flexible receptacles in a docking region, said arrangement being a starting position for three exemplary embodiments of methods according to the system described herein.

According to FIG. 1, in accordance with a method step a the closed ends 16, 16' are located opposite one another. Both the first receptacle 10 and the second receptacle 10' have according to the invention peelable inner sides 14 and outer sides 12 that can be firmly welded.

Figure 2:
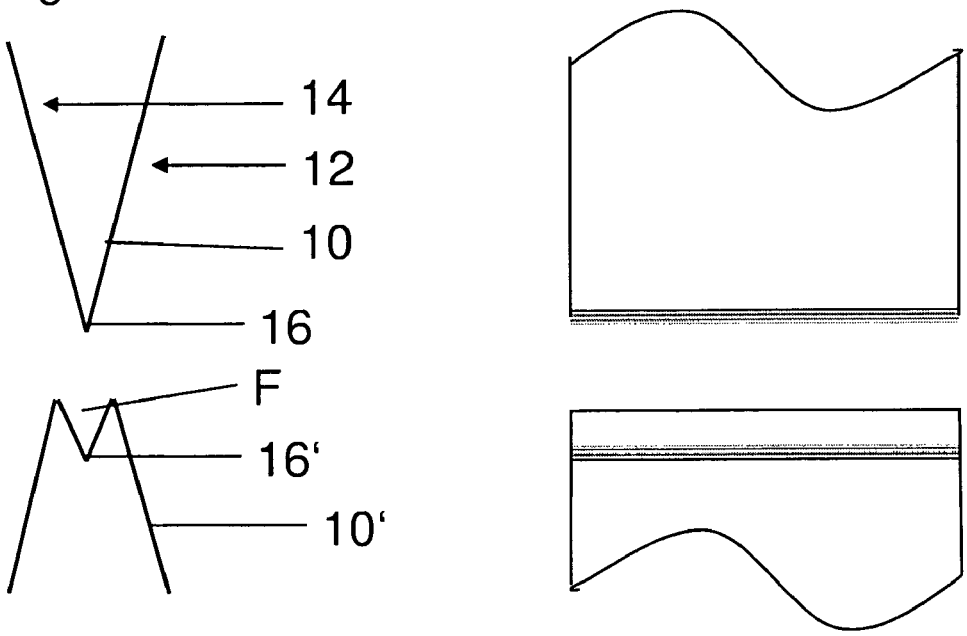
FIG. 2 shows schematically simplified illustrations of the ends from FIG. 1, wherein one of the ends has been turned inward (b.1.1) in accordance with a first exemplary embodiment of a method according to the system described herein so as to produce a receiving region.

As is schematically illustrated in FIG. 2, the receiving end 16' is turned inward in accordance with a first of the alternative method steps b.1.1 so as to produce a receiving region F for the penetrating end 16.

Figure 3:
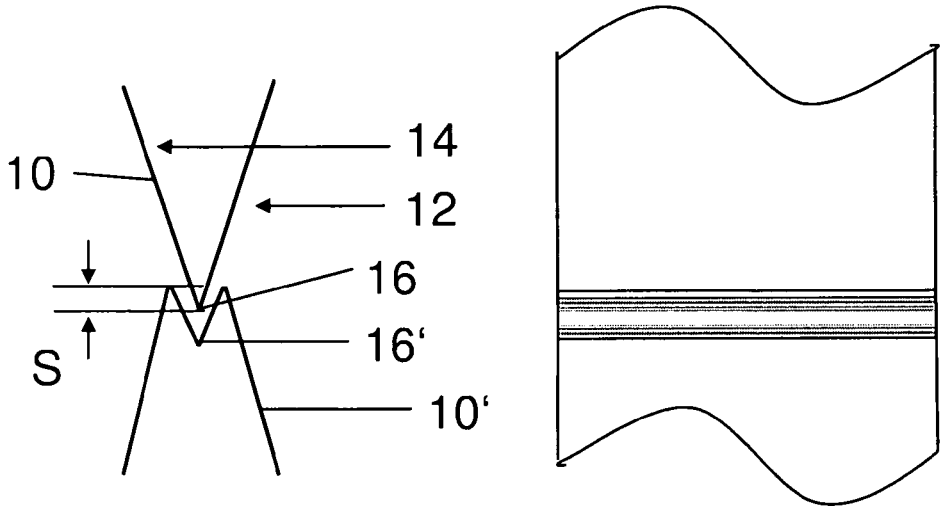
FIG. 3 shows schematically simplified illustrations of the ends from FIG. 2, wherein one end has been inserted (b.1.2) into the receiving region in order to prepare for a welding operation.

According to FIG. 3, in accordance with the first of the alternative method steps b.1.2, the penetrating end 16 of the first receptacle 10 is inserted into the receiving region F so that the penetrating end 16 is located in a welding region S in the receiving end 16'.

According to method step c, the ends 16, 16' are connected together by lateral pressing and hot welding. Care should be taken in this case that the hot welding takes place only in the welding region S and not outside in a region in which, on account of the turning-inward, the two outer sides of the receptacle 10' rest against one another without being spaced apart by the penetrating end 16 of the first receptacle 10. Corresponding weld seams between the inner and outer sides, respectively, are indicated by dots in the sectional views in FIGS. 4 and 5. In principle, in connections according to the invention, welding is carried out without applying additional material, while at the same time the inner and outer sides, respectively, of the walls of the films are pressed laterally together.

Figure 4:
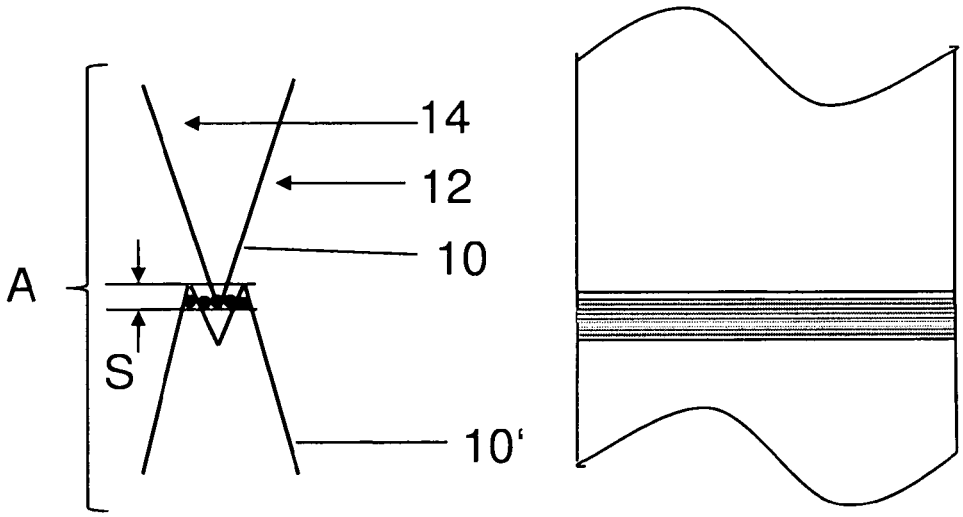
FIG. 4 shows schematically simplified illustrations of the ends from FIG. 3 after the ends have been welded (c)
Figure 5:
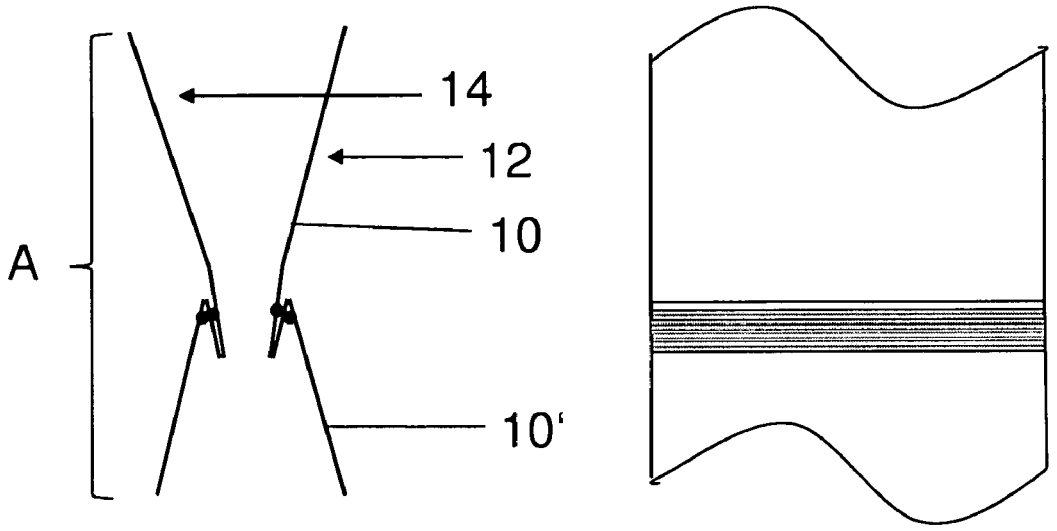
FIG. 5 shows schematically simplified illustrations of the ends from FIG. 4, which have been connected by welding (c), following subsequent lateral pulling (d) on the ends in a transferring situation.

FIG. 4 shows the receptacles 10', 10 connected together following the welding operation c.

The ends 16, 16' are pulled laterally according to a method step d. In the process the predetermined breaking point breaks. The welded connection between the inner sides 14 of the first receptacle 10 and between the inner sides of the second receptacle 10' is accordingly released so as to create a through-passage between the two receptacles 10, 10'. At the same time, the firm connection between the outer sides 12 of the receptacles 10, 10' remains intact. The result is illustrated schematically in FIG. 5.

According to a second exemplary embodiment of a method according to the invention, a second of the alternative method steps b.2 begins, following an arrangement a of the closed receptacles 16, 16' according to FIG. 1, as an alternative to the method step b.1.1, b.1.2, with an arrangement b.2 of two strips 32, 34 parallel to the ends 16, 16'. According to FIG. 7, these are two strips 32, 34 which are arranged parallel to one another and receive the ends 16, 16' between one another. The strips 32, 34 have a firmly weldable surface facing the ends 16, 16'.

In FIG. 8, according to a third exemplary embodiment of a method according to the invention, a continuous strip 36 is arranged around the ends 16, 16' in the method step b.2. The strip 36 can be formed by the strips 32, 34 from FIG. 7 being connected together at both ends. Alternatively, the encircling strip 36 can also be produced as a section of a continuous tube, the inner side of which is configured such that it can be welded firmly to the ends 16, 16'.

Figure 9:
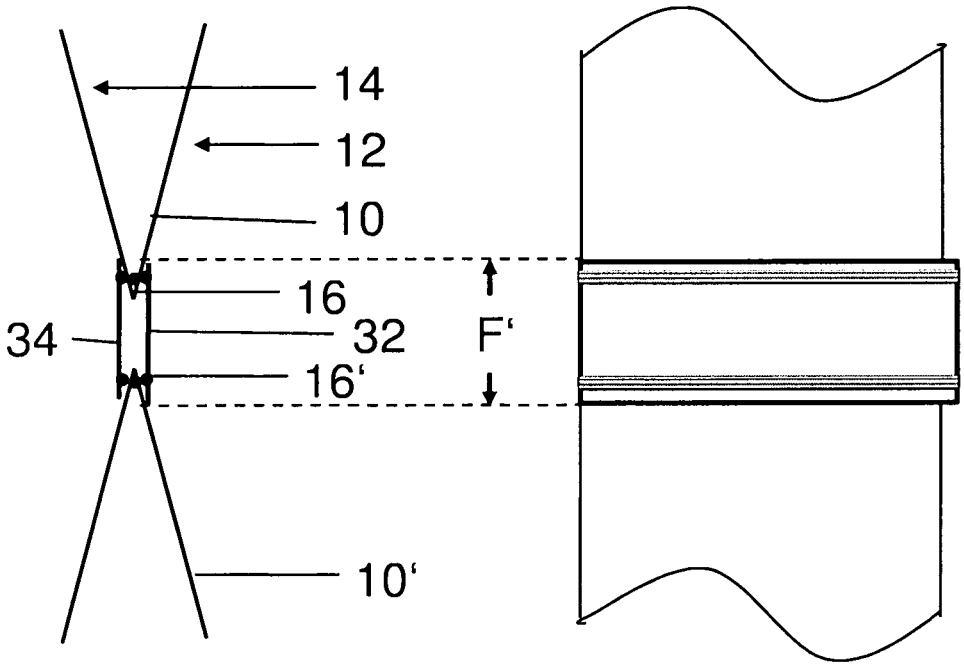
FIG. 9 shows schematically simplified illustrations of the ends and of the strips from FIG. 7 after the ends have been welded (c) to the strips.

The strips 32, 34, 36 from FIG. 7 or 8 are connected to the ends 16, 16' by lateral pressing and hot welding c according to FIG. 9. Care should be taken in this case that the hot welding takes place in a welding region in which the respective end 16, 16' is overlapped by the strip 32, 34, 36. Corresponding weld seams between the strips 32, 34, 36 and the outer sides 12 and between the inner sides 14 and the ends 16, 16' are indicated by dots in the sectional views in FIGS. 9 to 11. In principle, in connections according to the invention, welding is carried out without applying additional material, while at the same time the inner and outer sides, respectively, of the walls of the films and strips are pressed laterally together.

Figure 10:
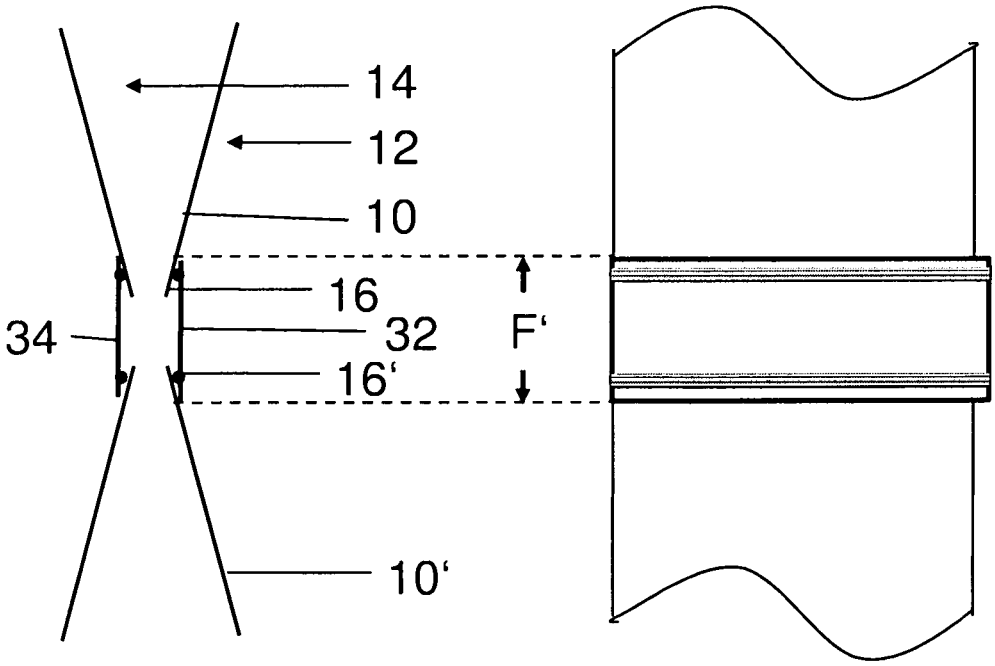
FIG. 10 shows schematically simplified illustrations of the ends from FIG. 9, which have been connected by welding, following subsequent lateral pulling (d) on the ends in a transferring situation.

FIG. 10 shows the receptacles 10', 10 connected together following the first welding operation c. The ends 16, 16' are pulled laterally according to the method step d, and in the process the predetermined breaking points between the inner sides 14 of the first receptacle 10 and between the inner sides 14 of the second receptacle 10' break so as to create the through-passage for the throughflow between the two receptacles 10, 10'. At the same time, the firm connection between the outer sides 12 of the receptacles 10, 10' and the strips 32, 34 or the strip 36 remains intact. The result is illustrated schematically in FIG. 10.

Figure 6:
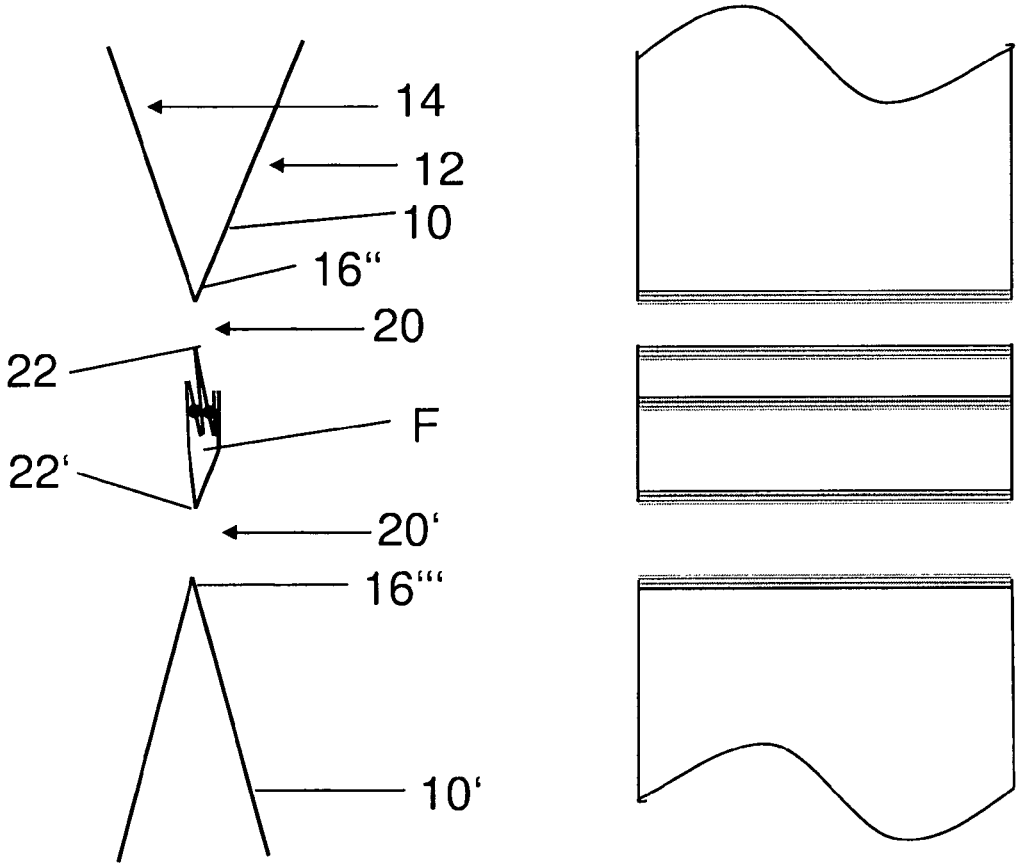
FIG. 6 shows schematically simplified illustrations of two separate receptacles which have been closed by a new welding operation (e, g) starting from FIG. 5 and a closed-off and separate receiving region located in between, FIG. 7 shows schematically simplified illustrations of the ends from FIG. 1, wherein, according to a second exemplary embodiment of a method according to the system described herein, two strips for bridging a gap between the receptacles are arranged (b.2) on both sides of the ends so as to produce a receiving region between the strips.
Figure 11:
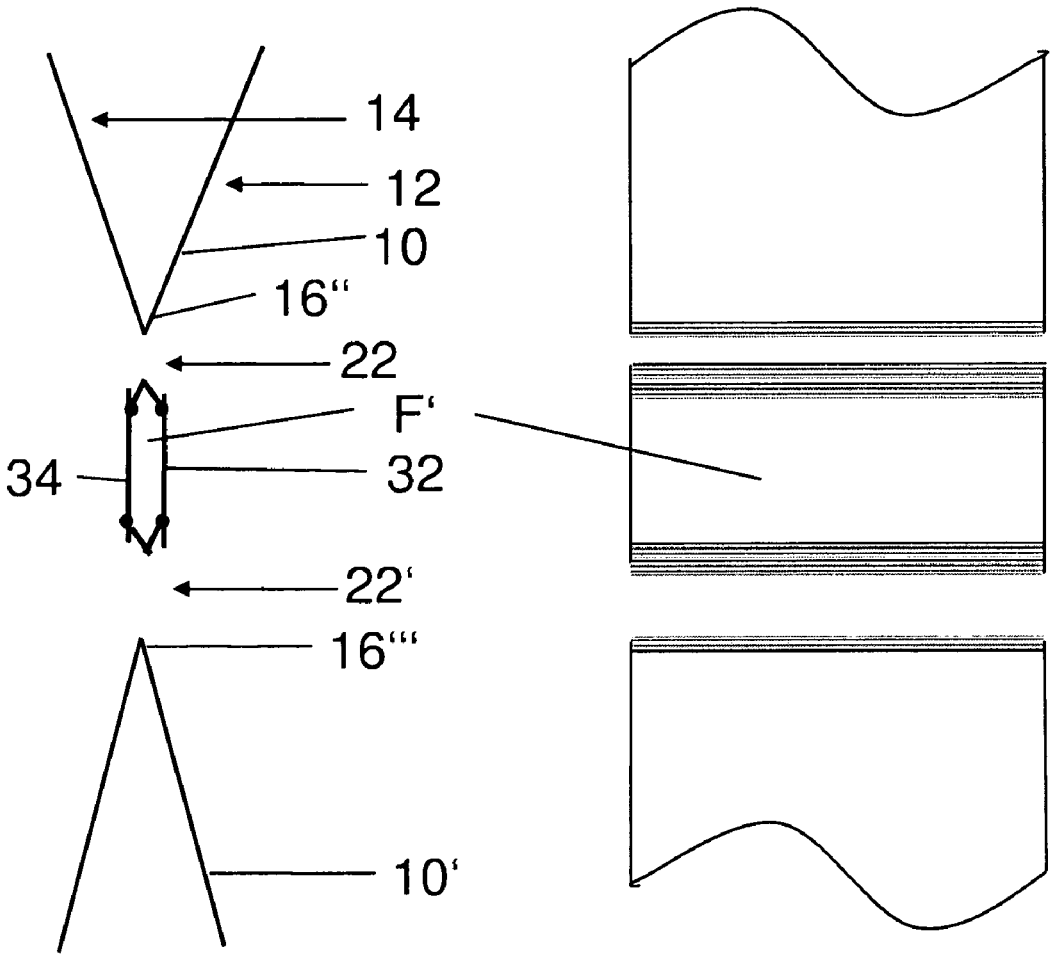

The result of an advantageous detachment f, h of a closed receiving region F in addition to the method according to the invention is illustrated schematically in FIG. 6 for the first exemplary embodiment and in FIG. 11 for the second exemplary embodiment and the third exemplary embodiment.

Depending on the requirements of the user, hot-welding in a manner analogous to the method steps c can advantageously be carried out above the receiving region F according to a method step e and/or below the receiving region F according to a method step g following a transferring operation. At the same time, a separating point 20, 20', in particular a perforation i, can also be provided within the respective weld seam, so that the inner sides 14 resting against one another are welded again in each case adjacent to the respective separating point 20, 20'. Thus, releasable welds are produced again at ends 16'', 16''' of reclosed receptacles 10, 10'. Similarly, the inner sides 14 of the receiving region F are closed at the ends 22, 22' of the receiving region and the receiving region F can thus be disposed of without a risk of contamination.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A method for the environmentally sealed connection of a first at least partially flexible receptacle to a second at least partially flexible receptacle, wherein the receptacles include films which have outer sides that are firmly weldable and inner sides that are releasably weldable to an inner seam, the method comprising:

arranging a receiving end of the second receptacle and a penetrating end of the first receptacle opposite one another in a docking region;

performing at least one of:

(i) turning the receiving end inward so as to produce a receiving region, and inserting the penetrating end into the receiving region, or (ii) arranging at least one strip in a direction parallel to the ends so as to produce a receiving region and so that the ends are at least partially enclosed by the strip;

welding the ends in a welding region within the receiving region; and pulling laterally on the ends to release the inner seam.

2. The method as claimed in claim 1, wherein, after the pulling, further comprising:

performing a first additional welding operation; and performing a first separating operation, both on a first side of the receiving region.

3. The method as claimed in claim 1, after the pulling, further comprising:

performing a second additional welding operation; and performing a second separating operation, both on a second side of the receiving region.

4. The method as claimed in claim 2, further comprising:

perforating, so that the separating operation takes place in the region of a perforated line and takes place during or after the first additional welding operation.

5. The method as claimed in claim 1, wherein the welding is executed as hot welding.

6. The method as claimed in claim 1, wherein at least one of the receptacles includes a closed section of a tubular continuous receptacle.

7. The method as claimed in claim 6, wherein the tubular continuous receptacle includes a continuous liner.

8. The method as claimed in claim 2, wherein the performing steps include a first synchronous cutting and sealing operation.

9. The method as claimed in claim 3, wherein the performing steps include a second synchronous cutting and sealing operation.

10. The method as claimed in claim 3, further comprising:

perforating, so that the separating operation takes place in the region of a perforated line and takes place during or after the second additional welding operation.

11. The method as claimed in claim 1, wherein, after the pulling, further comprising:

(i) performing a first additional welding operation; and performing a first separating operation, both on a first side of the receiving region; and (ii) performing a second additional welding operation; and performing a second separating operation, both on a second side of the receiving region.

12. The method as claimed in claim 11, further comprising:

perforating, so that the first separating operation and the second separating operation takes place in the region of a perforated line and takes place during or after the first additional welding operation and the second additional welding operation.

* * * * *